United States Patent [19]

Imai et al.

[11] Patent Number: 4,933,659

[45] Date of Patent: Jun. 12, 1990

[54] VOLTAGE NON-LINEAR RESISTOR AND METHOD OF PRODUCING THE SAME

[75] Inventors: Osamu Imai, Kasugai; Koichi Umemoto, Toyota, both of Japan

[73] Assignee: NGK Insulators, Ltd., Japan

[21] Appl. No.: 362,282

[22] Filed: Jun. 6, 1989

[30] Foreign Application Priority Data

Nov. 8, 1988 [JP] Japan ..... 63-280385

[51] Int. Cl.[5] ..... H01C 7/10

[52] U.S. Cl. ..... 338/20; 338/21; 29/620; 264/61; 252/519

[58] Field of Search ..... 338/20, 21; 264/61, 264/63; 29/610.1, 620; 252/518, 519, 520, 521; 427/101, 102, 103; 361/117, 127

[56] References Cited

U.S. PATENT DOCUMENTS

| | | | |
|---|---|---|---|
| 4,031,498 | 6/1977 | Hayashi et al. | 338/21 |
| 4,386,021 | 5/1983 | Kazuo et al. | 252/519 |
| 4,516,105 | 5/1985 | Imai et al. | 264/61 |
| 4,549,981 | 10/1985 | Gupta et al. | 264/61 |
| 4,551,268 | 11/1985 | Eda et al. | 252/519 |
| 4,692,735 | 9/1987 | Shoji et al. | 338/21 |
| 4,719,064 | 1/1988 | Nakata et al. | 264/61 |
| 4,724,416 | 2/1988 | Nakata et al. | 338/20 |
| 4,730,179 | 3/1988 | Nakata et al. | 338/20 |

FOREIGN PATENT DOCUMENTS 58-28802 2/1983 Japan .

*Primary Examiner*—Bruce A. Reynolds
*Assistant Examiner*—M. M. Lateef
*Attorney, Agent, or Firm*—Arnold, White & Durkee

[57] ABSTRACT

A voltage non-linear resistor having lightning discharge current withstanding capability, switching surge current withstanding capability, and voltage non-linear index $\alpha$, including a resistor element body consisting essentially of zinc oxide, and a side highly resistive layer composed of a zinc silicate phase consisting essentially of $Zn_2SiO_4$ and a spinel phase consisting essentially of $Zn_7Sb_2O_{12}$ arranged on a side surface of the resistor element body, can be attained, having a porosity of the resistor element body of 2% or less, zinc silicate particles existing continuously in the side highly resistive layer, and a porosity of 10% or less in a region of the side highly resistive layer within 30 μm or less from the resistor element body. A method of producing the voltage non-linear resistor is also provided.

3 Claims, 5 Drawing Sheets

Ratio: x340

0 100μm

Ratio: x 90

0 100μm

VOLTAGE NON-LINEAR RESISTOR AND METHOD OF PRODUCING THE SAME

BACKGROUND OF THE INVENTION

1. Field of the Invention

The present invention relates to a voltage non-linear resistor consisting essentially of zinc oxide, and a method of producing the same.

2. Related Art Statement

Heretofore, voltage non-linear resistors consisting essentially of zinc oxide have superior non-linear voltage-current characteristic properties, so that they are widely used as surge absorbers for surge absorption and lightning arrestor for voltage stabilization. The voltage non-linear resistors are produced by adding a small amount of bismuth oxide, antimony oxide, cobalt oxide, or manganese oxide for exhibiting a voltage non-linear property to the main component zinc oxide, mixing, granulating, and forming the admixture to form a formed body, sintering the formed body preferably after an application of an inorganic matter for forming a side highly resistive layer, and attaching electrodes to the sintered bodies.

For using voltage non-linear resistors thus obtained as lightning arrestor for absorbing a large surge, the voltage non-linear resistors desirably have a large discharge current withstanding capability. The discharge current withstanding capability can be expressed by a value of a maximum electric current that does not incur breakage or surface flash-over when an impulse electric current of a wave form of 4/10 μs is applied twice at an interval of 5 minutes and the electric current value is raised stepwise until the breakage or surface flash-over occurs.

Discharge current withstanding capability of the voltage non-linear resistor is considered to depend on voids or pores in the sintered body. Namely, the breakage at the time when the impulse electric current of the wave form of 4/10 μs is applied is considered to be due to thermal stress, so that an improvement of discharge current withstanding capability can be expected, if the voids are reduced and a mechanical strength of the sintered body is enlarged. In addition, if the voids are present in the sintered body at the time of passing an electric current therethrough, the electric current is concentrated at distal ends of the voids cross passing to the direction of the electric current. If the concentration occurs within a short period, such as 4/10 μs, heat conduction to the ambient is so small that a local temperature rise of the sintered body takes place. The local temperature rise generates a thermal stress which leads to breakage of the sintered body if the thermal stress exceeds a mechanical strength of the sintered body. Therefore, desirably the mechanical strength of the sintered body is enhanced, while the voids are removed in order to prevent concentration of the electric current at the distal ends of the voids. A method of obtaining a sintered body not having the voids is disclosed in Japanese Patent Application Laid-open No. 58-28,802, wherein temperature raise of a formed body from 800° C. to 1,150° C. during the temperature raising step of the sintering process is effected in a reduced pressure of not exceeding the atmospheric pressure.

However, the method of the Japanese Patent Application Laid-open No. 58-28,802 discloses merely an improvement of discharge current withstanding capability evaluated by an electric current of a rectangular wave form of 2 ms as regard to an effect of the decrease of the voids (to be referred to as "switching surge current withstanding capability", hereinafter), and nothing about discharge current withstanding capability evaluated by an impulse electric current of a wave form of 4/10 μs (to be referred to as "lightning discharge current withstanding capability", hereinafter). Switching surge current withstanding capability and lightning discharge current withstanding capability are originally different from each other in nature, as seen in breakage forms of penetration breakage of the former and burst breakage of the latter. Therefore, the voids are considered to have different influence on switching surge current withstanding capability from lightning discharge current withstanding capability. The "penetration breakage" used herein means a breakage of forming a penetration hole of a diameter of about 1 mm in the voltage non-linear resistor and decreasing the resistance of the resistor to 1 KΩ or less to lose the non-linear voltage-current characteristic property of the voltage non-linear resistor. The "burst breakage" used herein means a breakage of forming a crack in the voltage non-linear resistor or bursting the resistor into pieces. As described above, the burst breakage is caused by the thermal stress generated at the time of applying a lightning discharge current on the voltage non-linear resistor.

In addition, the method of the Japanese Patent Application Laid-open No. 58-28,802 conducts the heating to 1,150° C. in the sintering process in a reduced pressure, i.e., in a low oxygen partial pressure state, so that oxidation of the formed body begins for the first time after the heating temperature exceeded 1,150° C. in the temperature-raising step of the sintering process. Therefore, if the formed body to be sintered has some large size in diameter and thickness, such as a diameter of 40 mm and a thickness of 20 mm, a holding at the sintering temperature for a few hours can not sufficiently oxidize the interior of the formed body, so that the non-linear voltage-current characteristic property comparable to that of the ordinary product sintered in the atmosphere can not be obtained, though the voids are decreased. Moreover, if the holding time of the formed body at the sintering temperature is prolonged in order to oxidize the interior of the formed body, $Bi_2O_3$ component is evaporated during the sintering process, so that a non-homogeneous sintered body is merely obtained.

Furthermore, usual overvoltage protective apparatuses, such as a lightning arrestor insulator and the like, have to provide a side highly resistive layer on a side surface of the voltage non-linear resistor, in order to prevent a surface flash-over. The side highly resistive layer is usually formed by applying an inorganic matter on a side surface of a formed body to be sintered, and reacting the inorganic matter with the side surface of the formed body by sintering, so that it has a good coherent property to the sintered body. Thus, the inorganic matter applied on the side surface of the formed body should not peel off from the side surface, even when the formed body is shrunk by the sintering. In this respect, in the method of the aforementioned Japanese Patent Application Laid-open No. 58-28,802, the formed body shrinks rapidly at a temperature of around 850° C., so that a large difference of shrink is caused between the inorganic matter and the formed body to peel off the former from the latter. Thus, the method has a drawback in that a side highly resistive layer of a good coherent property and a homogeneous property can not be formed on a side surface of the voltage non-linear resistor.

SUMMARY OF THE INVENTION

An object of the present invention is to obviate the above drawbacks.

An other object of the present invention is to provide a splendid voltage non-linear resistor which can obtain a highly dense sintered body having a sufficient non-linear voltage-current property and still allows easy formation of a side highly resistive layer on a side surface thereof.

Another object of the present invention is to provide a method of producing such splendid voltage non-linear resistor.

The present invention is a voltage non-linear resistor including a resistor element body consisting essentially of zinc oxide, and a side highly resistive layer composed of a zinc silicate phase consisting essentially of $Zn_2SiO_4$ and a spinel phase consisting essentially of $Zn_7Sb_2O_{12}$, arranged on a side surface of the resistor element body, comprising a porosity of the resistor element body of 2% or less, zinc silicate particles existing continuously in the highly resistive layer, and a porosity of 10% or less in a region of the side highly resistive layer within 30 μm or less from the resistor element body.

Also, the present invention is a method of producing a voltage non-linear resistor, wherein a green body of the voltage non-linear resistor consisting essentially of zinc oxide and press formed into an appropriate form is primary sintered under a reduced pressure lower than the atmospheric pressure, and then secondary sintered in an oxidizing atmosphere of an oxygen particle pressure of ≧100 torr, comprising applying on a side surface of the green body or the primary sintered body a mixture for insulation coating containing at least a silicon compound, a bismuth compound, and an antimony compound respectively calculated as $SiO_2$, $Bi_2O_3$, and $Sb_2O_3$ on or in a range of a hexagonal region having six apexes of A ($SiO_2$ 93 mol %, $Bi_2O_3$ 4 mol %, $Sb_2O_3$ 3 mol %),
B ($SiO_2$ 93 mol %, $Bi_2O_3$ 2 mol %, $Sb_2O_3$ 5 mol %),
C ($SiO_2$ 83 mol %, $Bi_2O_3$ 2 mol %, $Sb_2O_3$ 15 mol %),
D ($SiO_2$ 75 mol %, $Bi_2O_3$ 10 mol %, $Sb_2O_3$ 15 mol %),
E ($SiO_2$ 75 mol %, $Bi_2O_3$ 15 mol %, $Sb_2O_3$ 10 mol %), and
F ($SiO_2$ 82 mol %, $Bi_2O_3$ 15 mol %, $Sb_2O_3$ 3 mol %)

in a ternary diagram of $SiO_2$, $Bi_2O_3$ and $Sb_2O_3$ showing their proportional percentage, and then sintering the applied body to form a side highly resistive layer at the side surface of the sintered body. This is the first aspect of the method of the present invention.

As a second aspect of the method of the present invention, the ternary mixture for insulation coating contains additionally a zinc compound admixed to the silicon compound, the bismuth compound, and the antimony compound, respectively calculated as ZnO, $SiO_2$, $Bi_2O_3$, and $Sb_2O_3$, in a mol ratio of $ZnO/SiO_2+Bi_2O_3+Sb_2O_3$ of 1.5 or less, to form a quaternary components system.

In the aforedescribed structure of the voltage non-linear resistor, the porosity of the resistor element body of 2% or less, the continuous presence of the zinc silicate particles in the side highly resistive layer, and the porosity of 10% or less of a region of the side highly resistive layer within 30 μm or less from the resistor element body, play a multiplicative effect, so that an excellent highly densified voltage non-linear resistor having a good highly resistive layer, a sufficient non-linear voltage-current property, and good electric properties, such as discharge current withstanding capability, etc., can be obtained.

If the porosity of the resistor element body of the secondary sintered body is 2% or less, preferably 1% or less, the characteristic properties of lightning discharge current withstanding capability and switching surge current withstanding capability can be improved by the highly densification of the resistor element body due to the decrease of the porosity. In order to decrease the porosity of the secondary sintered resistor element body to 2% or less, the primary sintering should be effected in a reduced pressure state lower than the atmospheric pressure, preferably 100 torr or less, so as to decrease the porosity of the primary sintered body to 15% or less, preferably 10% or less. In order to decrease the porosity of the secondary sintered body to 2% or less, the primary sintered body may be secondary sintered under a reduced pressure, which method is aside from the method of the present invention, and has drawbacks in that the voltage nonlineality index $\alpha$ of the secondary sintered body decreases to about 10 or less, the side highly resistive layer on the side surface of the resistor element body is likely to peel off from the element body, and lightning discharge current withstanding capability is decreased. In contrast, according to the method of the present invention, the secondary sintered body has a voltage nonlineality index $\alpha$ of 30 or more, so that it can obtain a good varistor property.

The continuous presence of zinc silicate particles in the zinc silicate phase constituting the side highly resistive layer of the voltage non-linear resistor, affords an improved electric insulation property of the highly resistive layer to advantageously prevent the surface flash-over or surface discharge. Preferably, the zinc silicate phase of continuous zinc silicate particles has a thickness of 20–120 μm, and the zinc silicate particles have an average particles diameter of 5–40 μm, viewed from the aspects of adhering property and electric insulation property of the side highly resistive layer. Preferably, the layer of a mixture of zinc silicate and spinel existing between the continuous phase of zinc silicate and the resistor element body has a thickness of 5–70 μm and the zinc silicate and the spinel have an average particles diameter of 1–10 μm respectively, the spinel phase existing on the continuous phase of zinc silicate is discontinuous and the spinel has an average particles diameter of 5–30 μm.

The porosity of 10% or less, preferably 5% or less, of a region of the side highly resistive layer within 30 μm or less from the resistor element body, gives an improved coherent adhesive property of the side highly resistive layer to the sintered resistor element body as well as the voltage non-linear resistor of improved properties.

The region of the side highly resistive layer within 30 μm or less from the sintered resistor element body is an intermingled phase consisting mainly of zinc silicate phase, spinel phase and bismuth oxide phase, which intermingled phase plays an important role in improving discharge current withstanding capability. Preferably, the side highly resistive layer has an average pores diameter of 15 μm or less, more preferably 10 μm or less, in order to obtain far improved characteristic properties.

In the first aspect of the method of the present invention, the primary sintering process of calcining the formed body under a reduced pressure, preferably 100 torr or less, and the secondary sintering process of oxidizing the calcined body in a determined or oxidizing atmosphere, are effected separately from each other. Thus, the primary sintering process pretreats the formed body under a reduced pressure so that the voids are easily removed from the primary sintered body in the next secondary sintering process, and the secondary sintering process decreases or removes the voids and oxidizes the primary sintered body completely. As a result, a highly densified sintered body can be obtained having a sufficient non-linear voltage-current property as well as an improved discharge current withstanding capability. Before or after the calcining process under a reduced pressure, if the ternary mixture for insulation coating of the desired composition of the compounds calculated as $SiO_2$, $Bi_2O_3$ and $Sb_2O_3$ is applied on a side surface of the green body or the primary sintered body, preferably on a side surface of the primary sintered body, the side highly resistive layer of good properties can be obtained. Preferably, the amount of silicon compound calculated as $SiO_2$ is 75–93 mol % in the ternary mixture, because if the amount is less than 75 mol % the side highly resistive layer tends to peel off from the secondary sintered body and the lightning discharge current withstanding capability can not be improved, while if the amount exceeds 93 mol % the side highly resistive layer shows a hygroscopic property and the lightning discharge current withstanding capability can not be improved. More preferably, the amount of silicon compound calculated as $SiO_2$ is 80–93 mol %. Hygroscopic property of the side highly resistive layer is tested by immersing a sample thereof in a fluorescent damage survey liquid under a pressure of 200 kg/cm$^2$ for 24 hours. Exhibition of hygroscopic property of the side highly resistive layer is not preferable from a viewpoint of reliability for a long period. As the silicon compound, preferably use is made of amorphous silica of an average particles diameter of 10 μm or less. Usually, the abovedescribed hygroscopic property of the side highly resistive layer tends to be noticeable in voltage non-linear resistors having varistor voltage $V_{lmA}$ of >260 V/mm.

In order to raise the varistor voltage, the secondary sintering temperature has to be lowered, because the reactivity between the resistor element body and the side highly resistive layer is lowered with the lowering of the secondary sintering temperature.

If the amount of bismuth compound calculated as $Bi_2O_3$ is less than 2 mol % in the mixture, the side highly resistive layer is likely to peel off from the secondary sintered body, while if the amount exceeds 15 mol %, lightning discharge current withstanding capability is decreased. Thus, the amount of bismuth compound is limited to 2–15 mol %, more preferably 2–10 mol %, calculated as $Bi_2O_3$. In addition, the amount of antimony compound is limited to 3–15 mol % calculated as $Sb_2O_3$, by a reason that a some amount of spinel ($Zn_7Sb_2O_{12}$) is necessary in the side highly resistive layer after the secondary sintering for improving lightning discharge current withstanding capability.

In the second aspect of the method of the present invention, even the voltage non-linear resistor of $V_{lmA}$>260 V/mm having a high hygroscopic property can be removed of its hygroscopic property sufficiently to provide a voltage non-linear resistor having a reliability for a long period, by using the quaternary mixture for insulation coating composed of the ternary mixture for insulation coating according to the first aspect of the method of the present invention and a desired amount of a zinc compound added thereto.

If a zinc compound is added to the ternary mixture in a mol ratio $ZnO/SiO_2+Bi_2O_3+Sb_2O_3$ of more than 1.5 by calculation of ZnO, $SiO_2$, $Bi_2O_3$, and $Sb_2O_3$, the mixture for insulation coating is likely to peel off at the time of application and lightning discharge current withstanding capability and switching surge current withstanding capability of the resistor can not be improved. Hence, the amount of zinc compound to be added to the ternary mixture is restricted to a mol ratio of $ZnO/SiO_2+Bi_2O_3+Sb_2O_3$ of 1.5 or less, preferably 1.0 or less. A zinc compound is considered to have a large effect on improving a coherent adhesivity of the side highly resistive layer to the resistor element body at low sintering temperatures.

If the thickness of the side highly resistive layer after the sintering is less than 30 μm, the effect of improving the lightning discharge current withstanding capability of the resistor becomes quite small, while, if the thickness exceeds 150 μm, the coherent adhesivity of the side highly resistive layer to the resistor element body becomes insufficient and apt to peel off. Hence the thickness is preferably 30–150 μm.

Though silicon compound, zinc compound, bismuth compound and antimony compound are mentioned as components for constituting the mixture for insulation coating, they are preferably those compounds that can be converted to oxides at a temperature of 1,000° C. or less, preferably 800° C. or less. Illustrative example thereof are carbonates, nitrates, or hydroxides, etc., of the respective elements, most preferably oxides of the respective elements.

Attached FIG. 1 shows the composition range restricted by the first aspect of the method of the present invention, for reference.

BRIEF DESCRIPTION OF THE DRAWINGS

For a better understanding of the present invention, reference is made to the accompanying drawings, in which.

Figure 2A:
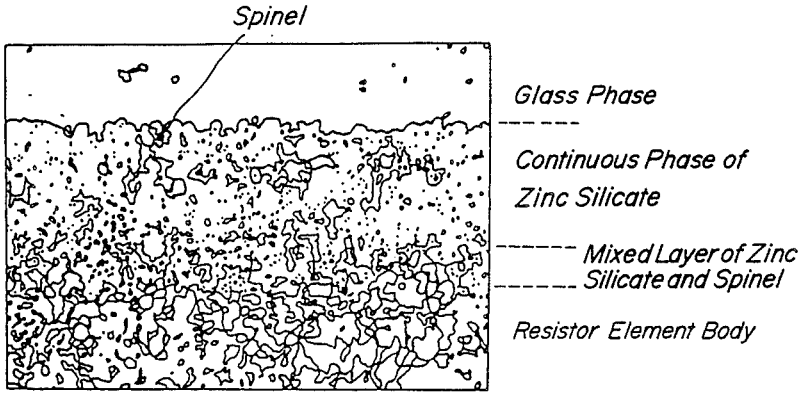
FIGS. 2*a* and 2*b* are an enlarged illustrative view of a non-color photograph of backscattered electron image by scanning electro microscopy (abbreviated as "SEM", hereinafter) showing a grain structure of an example and a referential example of the voltage non-linear resistor of the present invention, respectively.
Figure 2B:
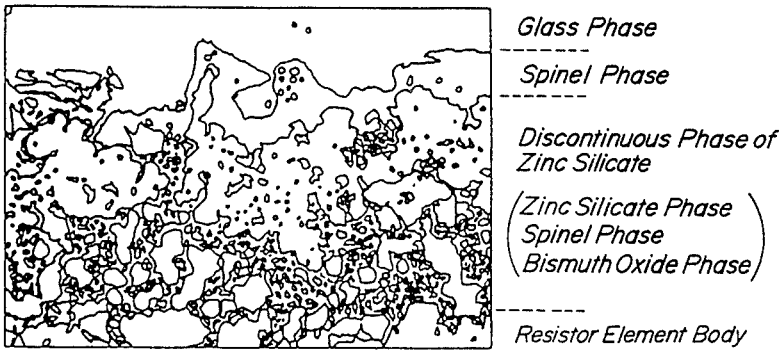
Figure 3A:
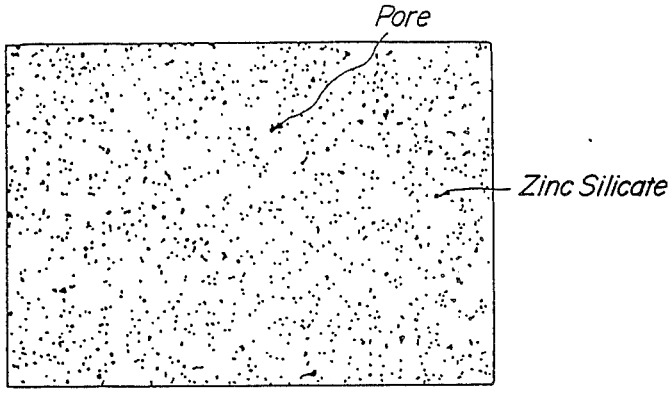
FIGS. 3*a* and 3*b* are an enlarged illustrative view of a non-color photograph taken by an optical microscope showing pores of a secondary sintered body of an example and a referential example of the voltage non-linear resistor of the present invention, respectively.
Figure 3B:
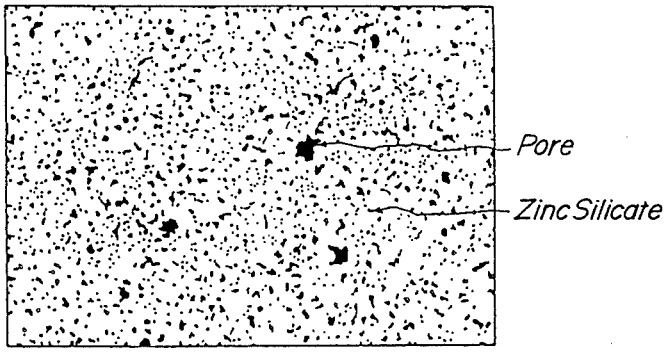
Figure 4A:
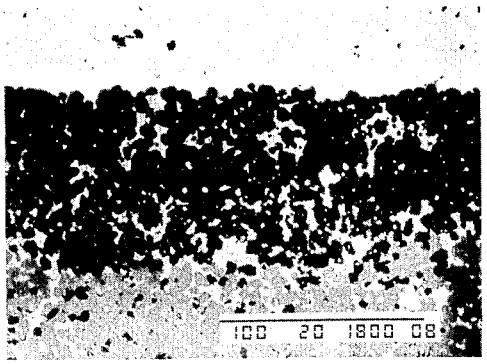
Figure 4B:
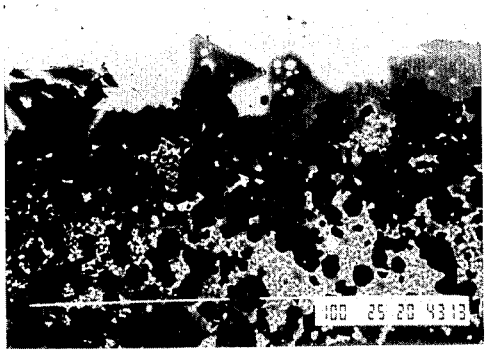
Figure 5A:
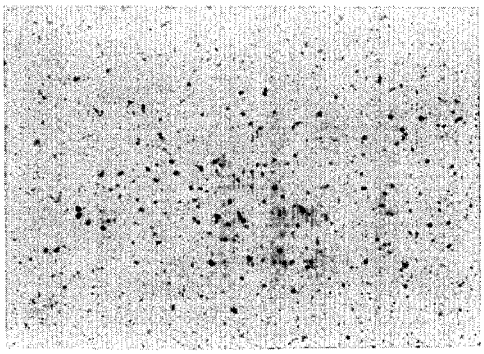
Figure 5B:
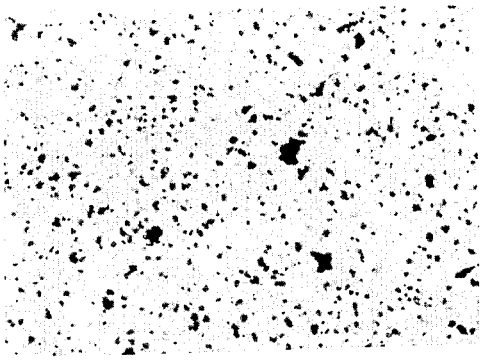

Referential photographs 1(*a*) and 1(*b*) are an original of the non-color photograph of FIGS. 2*a* and 2*b*, respectively; and Referential photographs 2(*a*) and 2(*b*) are an original of the non-color photograph of FIGS. 3*a* and 3*b*, respectively.

DESCRIPTION OF THE PREFERRED EMBODIMENTS

For obtaining the voltage non-linear resistor consisting essentially of zinc oxide, at first a raw material of zinc oxide adjusted to a desired fineness is mixed with a desired amount of an admixture of bismuth oxide, cobalt oxide, manganese oxide, antimony oxide, chromium oxide, silicon oxide preferably amorphous silicon oxide, nickel oxide, boron oxide, and/or silver oxide, etc., adjusted to a desired fineness. In this case, silver oxide and boron oxide may be replaced by silver nitrate and boric acid. Preferably, bismuth borosilicate glass containing silver is used. In addition, the admixture may be calcined at 800–1,000° C. and adjusted to a desired fineness, prior to the mixing with the raw material of zinc oxide. In such case, a desired amount of an aqueous solution of polyvinyl alcohol as a binder, and a desired amount of an aqueous solution of aluminum nitrate as an aluminum oxide source material, are added to these raw materials.

Then, the mixture is preferably evacuated under a reduced pressure of preferably 200 mmHg or less to form a slurry of the mixture of a water content of about 30–35 wt % and a viscosity of 100±50 cp. Subsequently, the slurry is supplied to a spray drying apparatus to produce granulates of an average particles diameter of 50–150 μm, preferably 80–120 μm, and a water content of 0.5–2.0 wt %, preferably 0.9–1.5 wt %. Thus obtained granulates are formed into a desired shape in a forming step under a shaping pressure of 800–1,000 kg/cm$^2$. The formed green body is primary sintered or calcined under conditions of heating and cooling rate of 30–100° C./hr and a reduced pressure state lower than the atmospheric pressure, preferably 100 torr or less, most preferably 10 torr or less, and a retention time at 800–1000° C. of 2–20 hrs.

Preferably, the formed body is embedded and sintered in a bed powder consisting essentially of zinc oxide and an admixture containing at least bismuth oxide. And preferably, before the calcining, the formed body is heated under conditions of heating and cooling rate of 10–100° C./hr, and a retention time at 400–600° C. of 1–10 hrs to dissipate and remove the binder from the formed body.

Next, the side highly resistive layer is formed at a side surface of the primary sintered body. For instance, a paste for insulation coating consisting of a mixture of a desired amount of $Bi_2O_3$, $Sb_2O_3$, ZnO and/or $SiO_2$, etc., added with an organic binder, such as ethylcellulose, butylcarbitol, n-butyl acetate, etc., is applied on a side surface of the primary sintered body to a thickness of 60–300 μm for the preparation of the side highly resistive layer. Alternatively, the paste may be applied on the formed body prior to the primary sintering. Then, the primary sintered body having the applied paste thereon is secondary sintered, namely, sufficiently sintered, under conditions of heating and cooling rates of 20–100° C./hr and a retention time at 1000–1300° C., preferably 1050–1250° C., of 3–7 hrs, in an oxidizing atmosphere of an oxygen partial pressure of ≧100 torr, preferably higher than the oxygen partial pressure in the atmosphere, to form the side highly resistive layer. The above oxygen partial pressure is necessary for imparting a sufficient voltage nonlineality to the produced voltage non-linear resistor. Preferably, the side highly resistive layer is coated with 100–300 μm thickness of a glass paste consisting of a glass powder and an organic binder, such as ethylcellulose, butylcarbitol, n-butyl acetate, etc., and heat treated in air under conditions of heating and cooling rate of 50–200° C./hr and a retention time at 400–900° C. of 0.5–4 hrs so as to form a glass layer.

Thus obtained voltage non-linear resistor is polished at the both end surfaces by a #400–2,000 polishing agent, such as SiC, $Al_2O_3$, diamond, etc., using water or preferably an oil as a polishing liquid. Thereafter, the polished surfaces are cleaned, and provided with electrodes, such as aluminum, etc., by means of metallizing, for example, to obtain a voltage non-linear resistor device for practical use.

Hereinafter, the present invention will be explained in more detail with reference to examples.

EXAMPLE 1

According to the method as described above, a raw material consisting of 1.0 mol % of $Bi_2O_3$, 0.5 mol % of $Co_3O_4$, 0.5 mol% of $MnO_2$, 1.0 mol % of $Sb_2O_3$, 0.5 mol % of $Cr_2O_3$, 0.5 mol% of NiO, 0.005 mol % of $Al_2O_3$, 1–2 mol % of $SiO_2$, and the rest of ZnO, is added with 0.1 wt % of bismuth borosilicate glass, and primary sintered and secondary sintered at various conditions as shown in the following Table 2, to prepare sample Nos. 1–9 and referential sample Nos. 1–6 of the voltage non-linear resistor of the present invention as shown in Table 2 having a diameter of 47 mm, a thickness of 20 mm, and a varistor voltage $V_{1mA}$ of 240–260 V/mm. In producing the resistors, various oxides as shown in the following Table 1 are used in admixture as the mixture for insulation coating for forming the side highly resistive layer. As the silicon oxide in the mixture for insulation coating, an amorphous silica of an average particles diameter of 8 μm is used. The mixture for insulation coating is applied on a side surface of the primary sintered body.

In the proceedings of the production process of the voltage non-linear resistors, the primary sintered bodies and the secondary sintered bodies are measured on their porosities, and the side highly resistive layers after the secondary sintering are measured on their conditions and porosities for an area within 30 μm from the sintered resistor body element. The results are shown in Table 2. The porosities are determined by polishing the samples, observing and taking photographs of the polished samples by SEM, and measuring a surface area percentage occupied by pores, i.e., pores surface area/body surface area or pores surface area/side highly resistive layer surface area from the photographs by a photograph analyzer. The produced voltage non-linear resistor devices are measured on lightning discharge current withstanding capability, switching surge current withstanding capability, and voltage nonlineality index $\alpha$. The results are shown also in Table 2.

The lightning discharge current withstanding capability is measured by applying an electric current of 100 KA, 110 KA or 120 KA of an impulse current wave form of 4/10 μs twice with an interval of 5 min. After the twice application of the electric current, non-destructed samples are expressed samples, are expressed by a symbol O and destructed samples by a symbol x. The switching surge current withstanding capability is measured by repeatedly applying an electric current of 400 A, 500 A or 600 A of a rectangular current wave form of 2 ms 20 times with an interval of each 2 min. After the 20 times application of the electric current, non-destructed samples are expressed by a symbol O, and destructed samples by a symbol x. The voltage nonlinearity indexes $\alpha$ are determined by measured voltage values at electric currents of 0.1 mA and 1 mA, from an equation $I=(V/C)^{\alpha}$, wherein I is a used electric current, V is a measured voltage, and C is a constant.

TABLE 1

| | A1 | A2 | A3 | A4 | B | (mol %) C |
|---|---|---|---|---|---|---|
| $SiO_2$ | 85 | 87 | 80 | 85 | 70 | 80 |
| $Bi_2O_3$ | 5 | 10 | 10 | 5 | 10 | 2 |
| $Sb_2O_3$ | 10 | 3 | 10 | 10 | 20 | 18 |
| ZnO* | | | | 60 | | |

*external amount of addition

TABLE 2

| Sample No. | Primary sintered body porosity (%) | Secondary sintered body porosity (%) | Side highly resistive layer: Zinc silicate | Side highly resistive layer: Porosity (%) | α | Lightning discharge current withstanding capability: 100 KA | 110 KA | 120 KA | Switching surge current withstanding capability: 400 A | 500 A | 600 A | Primary sintering: Maximum Temperature | Primary sintering: Vacuum (torr) | Secondary sintering: Maximum Temperature | Secondary sintering: Vacuum | Composition |
|---|---|---|---|---|---|---|---|---|---|---|---|---|---|---|---|---|
| Invention | | | | | | | | | | | | | | | | |
| 1 | 9 | 0.1 | continuous | 1.0 | 45 | O | O | O | O | O | O | 980° C., 5 hrs | 0.1 | 1130° C., 5 hrs | atmo- (sintered in air) | A1 |
| 2 | 11 | 0.7 | continuous | 2.9 | 50 | O | O | O | O | O | O | 980° C., 5 hrs | 1 | 1140° C., 5 hrs | atmo- spheric (sintered in air) | A2 |
| 3 | 10 | 1.0 | continuous | 4.8 | 47 | O | O | O | O | O | O | 980° C., 5 hrs | 2 | 1140° C., 5 hrs | atmo- spheric (sintered in air) | A3 |
| 4 | 10 | 0.4 | continuous | 0.05 | 48 | O | O | O | O | O | O | 980° C., 5 hrs | 0.2 | 1130° C., 5 hrs | atom- spheric (sintered in air) | A4 |
| 5 | 15 | 1.8 | continuous | 2.5 | 43 | O | O | X | O | O | X | 900° C., 10 hrs | 30 | 1130° C., 5 hrs | atmo- spheric (sintered in air) | A1 |
| 6 | 10 | 2.0 | continuous | 3.3 | 35 | O | O | X | O | O | X | 980° C., 5 hrs | 0.2 | 1150° C., 3 hrs | atmo- spheria ($pO_2$ partial pressure 100 torr) | A2 |
| 7 | 10 | 0.9 | continuous | 9.5 | 46 | O | O | X | O | O | O | 980° C., 5 hrs | " | 1130° C., 3 hrs | atom- spheric (sintered in air) | A3 |
| 8 | 10 | 0.9 | continuous | 4.5 | 44 | O | O | O | O | O | O | 980° C., 9 hrs | 10 | 1130°C., 5 hrs | atom- spheric (sintered in air) | A4 |
| 9 | 15 | 1.7 | continuous | 4.9 | 42 | O | O | X | O | O | O | 100° C., 20 hrs | 100 | 1130° C., 1130° C., | atom- spheric (sintered in air) | A1 |
| Referential | | | | | | | | | | | | | | | | |
| 1 | 20 | 6.0 | continuous | 8.8 | 46 | X | | | X | | | 900° C., 5 hrs | atmo- spheric | 1130° C., 5 hrs | atom- spheric (sintered in air) | A2 |
| 2 | 20 | 1.9 | continuous | 11* | 10 | O | X | | X | | | 900° C., | atmo- | 1130° C., | reduced pressure of 100 torr | A3 |
| 3 | 14 | 3.9 | continuous | 6.1 | 41 | O | X | | X | | | 930° C., 5 hrs | 20 | 1160° C., 1 hr. | atmo- spheric (sintered in air) | A4 |
| 4 | 11 | 1.1 | discontinuous | 7.2 | 46 | X | | | O | X | | 980° C., 5 hrs | 1 | 1130° C., 5 hrs | atmo- spheric (sintered in air) | B |
| 5 | 10 | 1.0 | continuous | 15.9 | 45 | X | | | O | X | | 980° C., 5 hrs | 1 | 1130° C., 5 hrs | atmo- spheric (sintered in air) | C |

TABLE 2-continued

| Sample No. | Primary sintered body porosity (%) | Secondary sintered body porosity (%) | Side highly resistive layer: Zinc silicate | Side highly resistive layer: Porosity (%) | α | Lightning discharge current withstanding capability: 100 KA | 110 KA | 120 KA | Switching surge current withstanding capability: 400 A | 500 A | 600 A | Primary sintering: Maximum Temperature | Primary sintering: Vacuum (torr) | Secondary sintering: Maximum Temperature | Secondary sintering: Vacuum | Composition |
|---|---|---|---|---|---|---|---|---|---|---|---|---|---|---|---|---|
| 6 | 10 | 1.2 | continuous | 8.9 | 12 | O | X | | X | | | 980° C., 5 hrs | 1 | 1130° C., 3 hrs | atmospheric ($pO_2$ = 50 torr) | A2 |

*Peeling off is formed at the side highly resistive layer

As seen from the results of the above Table 2, the sample Nos. 1–9 of the present invention which were subjected to the desired primary and secondary sinterings and having the side highly resistive layer of the desired composition and condition, can exhibit excellent characteristic properties in any of voltage nonlineality index α, lightning discharge current withstanding capability, and switching surge current withstanding capability, as compared with the referential sample Nos. 1–6 which do not satisfy the present invention in at least one condition.

EXAMPLE 2

In order to examine conditions of side highly resistive layers and an influence of the mixture for insulation coating for forming the side highly resistive layers upon voltage non-linear resistors, various compositions of ternary mixture are prepared in the same manner as in Example 1 to produce voltage non-linear resistors having varistor vOltage $V_{lmA}$ of 230–250 V/mm, as shown in the following Table 3.

In producing the resistors, the primary sintering of the formed bodies are effected at a condition of a reduced atmosphere of 0.2 torr, a sintering temperature of 980° C., and a holding time of 5 hrs. The primary sintered bodies have a porosity of 6%, and the secondary sintering is effected in air at 1,150° C. for 5 hrs. The secondary sintered bodies have porosities of 0.02–0.1%. The results are shown in the following Table 3.

TABLE 3(a)

| Sample No. | Composition of mixture for insulation coating (mol %): $SiO_2$ | $Bi_2O_3$ | $Sb_2O_3$ | Side highly resistive layer: Zinc silicate | Porosity (%) | α | Lightning discharge current withstanding capability: 100 KA | 110 KA | 120 KA | Switching surge current withstanding capability: 400 A | 500 A | 600 A | Note |
|---|---|---|---|---|---|---|---|---|---|---|---|---|---|
| Invention | | | | | | | | | | | | | |
| 1 | 93 | 4 | 3 | continuous | 2.3 | 45 | O | O | O | O | O | O | Amorphous silica the rest: oxides |
| 2 | 93 | 2 | 5 | " | 5.0 | 46 | O | O | O | O | O | O | |
| 3 | 83 | 2 | 15 | " | 3.1 | 47 | O | O | O | O | O | O | |
| 4 | 75 | 10 | 15 | " | 5.3 | 47 | O | O | X | O | O | X | |
| 5 | 75 | 15 | 10 | " | 6.1 | 46 | O | O | X | O | O | O | |
| 6 | 82 | 15 | 3 | " | 8.8 | 47 | O | O | X | O | O | O | |
| 7 | 85 | 5 | 10 | " | 1.1 | 47 | O | O | O | O | O | O | |
| 8 | 87 | 10 | 3 | " | 3.0 | 48 | O | O | O | O | O | O | |
| 9 | 80 | 10 | 10 | " | 4.5 | 45 | O | O | O | O | O | O | |
| 10 | 80 | 5 | 15 | " | 3.8 | 45 | O | O | O | O | O | O | |
| 11 | 90 | 5 | 5 | " | 2.6 | 47 | O | O | O | O | O | O | |
| 12 | 85 | bismuth hydroxide 5 | $Sb_2O_5$ 10 | continuous | 7.3 | 45 | O | O | X | O | O | X | Amorphous silica the rest: hydroxides |
| 13 | 80 | bismuth hydroxide 10 | $Sb_2O_5$ 10 | " | 9.4 | 44 | O | O | X | O | O | O | |
| Referential | | | | | | | | | | | | | |
| 1 | 95 | 2 | 3 | " | 13.5 | 45 | X | | | O | X | | Amophous silica rest rest: oxides |
| 2 | 90 | 0 | 10 | " | 12.5 | 46 | X | | | X | | | |
| 3 | 80 | 2 | 18 | " | 14.0 | 45 | X | | | O | X | | |
| 4 | 70 | 10 | 20 | discontinuous | 7.0 | 44 | O | X | | O | O | X | |
| 5 | 75 | 20 | 5 | discontinuous | 9.8 | 45 | X | | | O | O | X | |
| 6 | 90 | 10 | 0 | continuous | 15.1 | 45 | X | | | O | O | X | |

Figure 1:
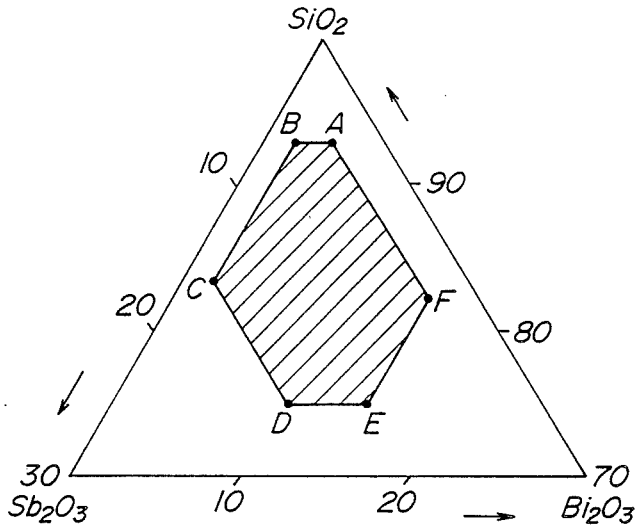
FIG. 1 is a ternary diagram of $SiO_2$-$Sb_2O_3$-$Bi_2O_3$ system showing the composition range restricted by the first aspect of the present method.

As seen from the results of the above Table 3, the sample Nos. 1–13 of the present invention which used a desired range of composition, namely a range of composition as shown in FIG. 1, of the ternary mixture for insulation coating consisting of silica compound, bismuth compound, and antimony compound, can obtain excellent characteristic properties in any of voltage nonlineality index α, lightning discharge current withstanding capability, and switching surge current withstanding capability, as compared with the referential sample Nos. 1–6 which do not satisfy the desired range of composition in at least one item.

EXAMPLE 3

In order to examine conditions or states of side highly resistive layers formed on side surface of hygroscopic voltage non-linear resistors having a varistor voltage $V_{lmA}$ of 480–500 V/mm and an influence of the mixture for insulation coating for forming the side highly resistive layers upon the voltage non-linear resistors, formed green bodies are prepared having the same composition with those of Examples 1 and 2 except that the amount of $SiO_2$ is 8–9 mol %, and various compositions of a quaternary mixture consisting of the ternary mixture of Example 2 and a desired amount of ZnO added thereto in external amount are applied on side surface of the formed green bodies to produce voltage non-linear resistors having a varistor voltage $V_{lmA}$ of 480–500 V/mm, as shown in the following Table 4.

In producing the resistors, the primary sintering of the formed bodies is effected at a condition of a reduced pressure of 0.2 torr, a temperature of 900° C., and a 900° C. holding time of 2 hrs, and the secondary sintering is effected in air at 1,060° C. for a holding time of 5 hrs. The same characteristic properties are measured as in Examples 1 and 2, namely, voltage nonlineality index $\alpha$, lightning discharge current withstanding capability, and switching surge current withstanding capability. In addition, for comparison, same evaluation tests are effected on voltage non-linear resistors which were produced by applying a ternary mixture for insulation coating on side surface of formed green bodies having a varistor voltage $V_{lmA}$ of 480–500 V/mm. The results are shown in the following Table 4.

TABLE 4(a)

| Sample No. | Composition of mixture for insulation coating (mol %) $SiO_2$ | $Bi_2O_3$ | $Sb_2O_3$ | ZnO | $\alpha$ | Lightning discharge current withstanding capability 70 KA | 80 KA | 90 KA | Switching surge current withstanding capability 300 A | 400 A | 500 A | Side highly resistive layer Zinc silicate | Porosity (%) |
|---|---|---|---|---|---|---|---|---|---|---|---|---|---|
| Invention | | | | | | | | | | | | | |
| 1 | 90 | 5 | 5 | 0 | 35 | O | O | X | O | O | O | continuous | 5.0 |
| 2 | " | " | " | 30 | 37 | O | O | O | O | O | O | " | 2.5 |
| 3 | " | " | " | 60 | 34 | O | O | O | O | O | O | " | 3.2 |
| 4 | " | " | " | 100 | 33 | O | O | O | O | O | X | " | 4.1 |
| 5 | " | " | " | 150 | 32 | O | O | X | O | O | X | " | 8.8 |
| 6 | 85 | 5 | 10 | 0 | 39 | O | O | X | O | O | O | " | 2.5 |
| 7 | " | " | " | 30 | 35 | O | O | O | O | O | O | " | 4.2 |
| 8 | " | " | " | 60 | 42 | O | O | O | O | O | O | " | 3.8 |
| 9 | " | " | " | 100 | 39 | O | O | O | O | O | O | " | 4.9 |
| 10 | " | " | " | 150 | 34 | O | O | X | O | O | X | " | 7.2 |
| 11 | 80 | 10 | 10 | 0 | 40 | O | O | X | O | O | O | " | 1.9 |
| 12 | 80 | 10 | 10 | 30 | 35 | O | O | O | O | O | O | continuous | 3.4 |
| 13 | " | " | " | 60 | 40 | O | O | O | O | O | O | " | 4.1 |
| 14 | " | " | " | 100 | 37 | O | O | O | O | O | O | " | 4.0 |
| 15 | " | " | " | 150 | 39 | O | O | X | O | O | X | " | 9.1 |
| 16 | 75 | bismuth hydroxide 10 | $Sb_2O_5$ 15 | Zinc nitrate 60 | 33 | O | O | X | O | O | X | " | 5.9 |
| Referential | | | | | | | | | | | | | |
| 1 | 90 | 5 | 5 | 200 | 35 | O | X | | X | | | " | 13.2 |
| 2 | 85 | 5 | 10 | 200 | 37 | O | X | | X | | | " | 12.9 |
| 3 | 80 | 10 | 10 | 200 | 40 | O | X | | X | | | " | 15.0 |
| 4 | 70 | 10 | 20 | 60 | 35 | X | | | O | X | | dis-continuous | 8.5 |

As seen from the results of the above Table 4, the sample Nos. 2–5, 7–10 and 12–16 of the present invention which used the quaternary mixture for insulation coating composed of the ternary mixture consisting of bismuth compound, silicon compound, and antimony compound, and a desired amount of ZnO added thereto in external amount, can obtain excellent characteristic properties in any of voltage nonlineality index $\alpha$, lightning discharge current withstanding capability, and switching surge current withstanding capability, as compared with the referential sample Nos. 1–4 which have amounts of ZnO beyond the scope of the present invention.

Also, it is seen that the sample Nos. 2–5, 7–10 and 12–16 of the present invention have better lightning discharge current withstanding capability than the sample Nos. 1, 6 and 11 of the present invention which use the ternary mixture for insulation coating without adding a zinc compound, however, an addition of a too large amount of the zinc compound to the ternary mixture for insulation coating leads to decrease or somewhat worse switching surge current withstanding capability, even though the addition of the zinc compound is within the scope of the present invention.

The produced side highly resistive layers are tested on hygroscopic property to find out that the quaternary mixture for insulation coating gives usually an improved non-hygroscopic property than the ternary mixture for insulation coating.

Referring to FIGS. 2*a* and 2*b* showing respectively a cross sectional view of a grain structure of a side highly resistive layer formed at a side of a voltage non-linear resistor of the present invention and a referential example, FIG. 2*a* of the present resistor shows an existence of a continuous phase of gray black zinc silicate of a thickness of about 80–90 μm approximately at the central portion of the figure and an existence of an intermingled layer of gray black zinc silicate and white gray spinel between the continuous phase of zinc silicate and the resistor element body. In contrast, FIG. 2*b* of the referential resistor shows that the zinc silicate phase at the central portion of the figure is discontinuous and white bismuth oxide phases and white gray spinel phases are dispersed in the zinc silicate phase.

Referring to FIGS. 3*a* and 3*b* showing respectively pores of the secondary sintered body of the present invention and a referential example, the black portions are pores and the black gray portions are zinc silicate. By comparing FIG. 3*a* with FIG. 3*b*, it is seen that the pores of the secondary sintered body of the present invention are extensively decreased as compared with those of referential example.

As apparent from the foregoing explanations, the present invention can provide excellent voltage non-linear resistors having a high density, a superior nonlinearity, and various splendid discharge current withstanding capabilities by defining the condition of the side highly resistive layer and the porosity of the resistor element body.

For achieving the above definitions, the method of the present invention for producing the voltage non-linear resistors separately effects the primary sintering of the formed body under reduced pressure and the secondary sintering in an oxidizing atmosphere, while using a ternary mixture for insulation coating consisting of a silicon compound, a bismuth compound, and an antimony compound, or a quaternary mixture for insulation coating consisting of the ternary mixture and a zinc compound added thereto, so that excellent voltage nonlinear resistors having high density, a good voltage nonlineality, and superior discharge current withstanding capabilities, can be obtained. The voltage non-linear resistors of the present invention have also a good electrical life as well as a good discharge voltage property.

Although the present invention has been explained with specific examples and numeral values, it is of course apparent to those skilled in the art that various changes and modifications thereof are possible without departing from the broad spirit and aspect of the present invention as defined in the appended claims.

What is claimed is:

1. A voltage non-linear resistor including a resistor element body consisting essentially of zinc oxide, and a side highly resistive layer composed of a zinc silicate phase consisting essentially of $Zn_2SiO_4$ and a spinel phase consisting essentially of $Zn_7Sb_2O_{12}$, arranged on a side surface of the resistor element body, comprising a porosity of the resistor element body of 2% or less, zinc silicate particles existing continuously in the side highly resistive layer, and a porosity of 10% or less in a region of the side highly resistive layer within 30 μm or less from the resistor element body.

2. A method of producing a voltage non-linear resistor, wherein a green body of the voltage non-linear resistor consisting essentially of zinc oxide and press formed into an appropriate form is primary sintered under a reduced pressure lower than the atmospheric pressure, and then secondary sintered in an oxidizing atmosphere of an oxygen partial pressure of ≧100 torr, comprising applying on a side surface of the green body or the primary sintered body a mixture for insulation coating containing at least a silicon compound, a bismuth compound, and an antimony compound respectively calculated as $SiO_2$, $Bi_2O_3$, and $Sb_2O_3$ on or in a range of a hexagonal region having six apexes of A ($SiO_2$ 93 mol %, $Bi_2O_3$ 4 mol %, $Sb_2O_3$ 3 mol %),
B ($SiO_2$ 93 mol %, $Bi_2O_3$ 2 mol %, $Sb_2O_3$ 5 mol %),
C ($SiO_2$ 83 mol %, $Bi_2O_3$ 2 mol %, $Sb_2O_3$ 15 mol %),
D ($SiO_2$ 75 mol %, $Bi_2O_3$ 10 mol %, $Sb_2O_3$ 15 mol %),
E ($SiO_2$ 75 mol %, $Bi_2O_3$ 15 mol %, $Sb_2O_3$ 10 mol %), and
F ($SiO_2$ 82 mol %, $Bi_2O_3$ 15 mol %, $Sb_2O_3$ 3 mol %)

in a ternary diagram of $SiO_2$, $Bi_2O_3$ and $Sb_2O_3$ showing their proportional percentage, and then sintering the applied body to form a side highly resistive layer at the side surface of the sintered body.

3. A method as defined in claim 2, wherein the ternary mixture for insulation coating contains additionally a zinc compound admixed to the silicon compound, the bismuth compound, and the antimony compound, respectively calculated as ZnO, $SiO_2$, $Bi_2O_3$, and $Sb_2O_3$, in a mol ratio of $ZnO/SiO_2+Bi_2O_3+Sb_2O_3$ of 1.5 or less, to form a quaternary components system.

* * * * *